US008207686B2

(12) United States Patent
Sloan

(10) Patent No.: US 8,207,686 B2
(45) Date of Patent: Jun. 26, 2012

(54) LED CONTROLLER AND METHOD USING VARIABLE DRIVE CURRENTS

(75) Inventor: Thomas C. Sloan, Santa Barbara, CA (US)

(73) Assignee: The Sloan Company, Inc., Ventura, CA (US)

( * ) Notice: Subject to any disclaimer, the term of this patent is extended or adjusted under 35 U.S.C. 154(b) by 693 days.

(21) Appl. No.: 11/470,172

(22) Filed: Sep. 5, 2006

(65) Prior Publication Data

US 2008/0054390 A1 Mar. 6, 2008

(51) Int. Cl.
*H05B 37/02* (2006.01)

(52) U.S. Cl. ..... 315/307; 315/224; 315/149

(58) Field of Classification Search ..... 315/149, 315/159, 224, 291, 307–308, 312; 362/227, 362/234, 253, 276, 612, 800
See application file for complete search history.

(56) References Cited

U.S. PATENT DOCUMENTS

| | | | | |
|---|---|---|---|---|
| 4,962,687 | A | 10/1990 | Belliveau et al. | 84/464 |
| 6,016,038 | A | 1/2000 | Mueller et al. | 315/291 |
| 6,150,774 | A | 11/2000 | Mueller et al. | 315/291 |
| 6,211,626 | B1 | 4/2001 | Lys et al. | 315/291 |
| 6,340,868 | B1 | 1/2002 | Lys et al. | 315/185 |
| 6,441,558 | B1 | 8/2002 | Muthu et al. | 315/149 |
| 6,586,895 | B2 * | 7/2003 | Weber | 315/370 |
| 6,753,661 | B2 * | 6/2004 | Muthu et al. | 315/307 |
| 6,930,452 | B2 | 8/2005 | De Krijger et al. | 315/192 |
| 6,963,175 | B2 * | 11/2005 | Archenhold et al. | 315/291 |
| 6,967,448 | B2 * | 11/2005 | Morgan et al. | 315/295 |
| 7,012,382 | B2 * | 3/2006 | Cheang et al. | 315/291 |
| 7,106,036 | B1 * | 9/2006 | Collins | 323/282 |
| 7,497,590 | B2 * | 3/2009 | Rains et al. | 362/231 |
| 7,573,210 | B2 * | 8/2009 | Ashdown et al. | 315/307 |
| 2003/0214259 | A9 * | 11/2003 | Dowling et al. | 315/312 |
| 2004/0196225 | A1 * | 10/2004 | Shimada | 345/82 |
| 2005/0023991 | A1 * | 2/2005 | Kemper | 315/291 |
| 2006/0017401 | A1 | 1/2006 | Hui et al. | |
| 2006/0033443 | A1 | 2/2006 | Ishii et al. | |
| 2006/0237636 | A1 * | 10/2006 | Lyons et al. | 250/228 |

(Continued)

FOREIGN PATENT DOCUMENTS

EP 1662583 A 5/2006

OTHER PUBLICATIONS

Abstracts of Japan 60 164371A (Toyoda Gosei KK) Date: Aug. 27, 1985.

(Continued)

*Primary Examiner* — Tung X Le
(74) *Attorney, Agent, or Firm* — Koppel, Patrick, Heybl & Philpott

(57) ABSTRACT

A system and method is disclosed for illuminating a plurality of emitters such as light emitting diodes (LEDs). The system comprises a plurality of LEDs and a circuit to provide a digital signal. An LED drive circuit is included comprising a first converter for converting the digital signal to one or more analog voltages. The LED drive circuit further comprises a second converter that converts the one or more analog voltages into corresponding one or more drive currents. Each of the drive currents is applied to at least one of the plurality of LEDs to cause the at least one of the plurality of LEDs to emit light. The intensity of emission of the LEDs is related to the level of the applied drive current.

27 Claims, 6 Drawing Sheets

U.S. PATENT DOCUMENTS

2007/0236154 A1* 10/2007 Lee ..... 315/246
2007/0276455 A1* 11/2007 Fiset ..... 607/91
2008/0001850 A1* 1/2008 Champion et al. ..... 345/7
2008/0012997 A1* 1/2008 Reuter ..... 348/771
2008/0048951 A1* 2/2008 Naugler et al. ..... 345/82
2008/0122607 A1* 5/2008 Bradley ..... 340/468
2008/0191631 A1* 8/2008 Archenhold et al. ..... 315/158
2008/0224024 A1* 9/2008 Ashdown ..... 250/205

OTHER PUBLICATIONS

PCT Search Report and Written Opinion Mailed on Feb. 7, 2008 PCT/US2007/016882.

PCT Preliminary Report on related PCT application No. PCT/US2007/016882, dated Mar. 19, 2009.

* cited by examiner

LED CONTROLLER AND METHOD USING VARIABLE DRIVE CURRENTS

BACKGROUND OF THE INVENTION

1. Field of the Invention

This invention relates to a system and method for controlling the illumination of multiple LEDs.

2. Description of the Related Art

Developments in light emitting diodes ("LEDs") have resulted in devices that are brighter, more efficient and more reliable. LEDs are now being used in many applications that were previously the realm of incandescent bulbs; some of these include displays, automobile taillights and traffic signals. As the efficiency of LEDs improves it is expected that they will be used in most lighting applications.

Different controllers have been developed to drive multiple light sources. U.S. Pat. No. 4,962,687 to Belliveau et al. discloses a variable color lighting system which includes light fixtures controlled from a central processor unit which includes a plurality of control channels. Each light fixture includes a plurality of chromatic light sources, and the intensity of each chromatic light source is controlled in accordance with a program from the central processor over the control channels. Each light fixture is assigned a channel address, and responds only to a digital input packet from the central controller that has the same address. The digital input packet controls how the light fixture changes color intensities.

U.S. Pat. No. 6,016,038 to Mueller et al. discloses a system with pulse width modulated current control for an LED lighting assembly, where each current-controlled unit is uniquely addressable and capable of receiving illumination color information on a computer lighting network. The invention can include a binary tree network configuration of lighting units (nodes) and can comprise a heat dissipating housing made out of a heat-conductive material, for housing the lighting assembly. The heat dissipating housing contains two stacked circuit boards holding respectively the power module and the light module. The light module is adapted to be conveniently interchanged with other light modules having programmable current and hence maximum light intensity, ratings. (See also U.S. Pat. Nos. 6,150,774; 6,211,626 and 6,340,868).

U.S. Pat. No. 6,441,558 to Murtha discloses an LED luminary system for providing power to LED light sources to generate a desired light color which comprises a power supply stage configured to provide a DC current signal. A light mixing circuit is coupled to said power supply stage and includes a plurality of LED light sources with red, green and blue colors to produce various desired lights with desired color temperatures. A controller system is coupled to the power supply stage and is configured to provide control signals to the power supply stage so as to maintain the DC current signal at a desired level for maintaining the desired light output. The controller system is further configured to estimate lumen output fractions associated with the LED light sources based on junction temperature of the LED light sources and chromaticity coordinates of the desired light to be generated at the light mixing circuit. The light mixing circuit further comprises a temperature sensor for measuring the temperature associated with the LED light sources and a light detector for measuring lumen output level of light generated by the LED light sources. Based on the temperatures measured, the controller system determines the amount of output lumen that each of the LED light sources need to generate in order to achieve the desired mixed light output, and the light detector in conjunction with a feedback loop maintains the required lumen output for each of the LED light sources.

U.S. Pat. No. 6,930,452 to De Krijger et al. discloses a circuit arrangement for driving an LED array comprising red, green and blue LEDs, a control loop is added for limiting the duty cycles of the control signals for driving the red, green and blue LEDs. In case one of the duty cycles reaches the limit value, the reference signals for the red, green and blue light are decreased with the same relative amount. The color point of the light is thereby maintained, even when the efficiency of part of the LEDs decreases.

SUMMARY OF THE INVENTION

One embodiment of a system according to the present invention for illuminating an emitter comprises an emitter and a circuit programmed to provide a digital signal. A drive circuit is arranged to accept said digital signal and generate a drive current signal having a level based at least partially on the digital signal. The drive signal is applied to the emitter to cause it to emit light, with the intensity of emission from the emitter dependent at least partially upon the level of said drive current.

One system for illuminating a plurality of light emitting diodes (LEDs) according to the present invention comprises a plurality of LEDs and a circuit to provide a digital signal. A first converter is included for converting the digital signal to one or more analog voltages. A second converter converts the one or more analog voltages into corresponding one or more drive currents, with each of the drive currents applied to at least one of the plurality of LEDs to cause the at least one of the plurality of LEDs to emit light. The intensity of emission of the LEDs is related to the level of the applied drive current.

One embodiment of a method for illuminating emitters comprises providing one or more emitters and generating a digital signal. The digital signal is converted to one or more analog voltages and each of the one or more analog voltages is converted to corresponding one or more drive currents. Each of the one or more drive currents is applied to at least one of the one or more emitters.

These and other features and advantages of the invention will be apparent to those skilled in the art from the following detailed description, taken together with the following drawings:

DETAILED DESCRIPTION OF THE INVENTION

Figure 1:
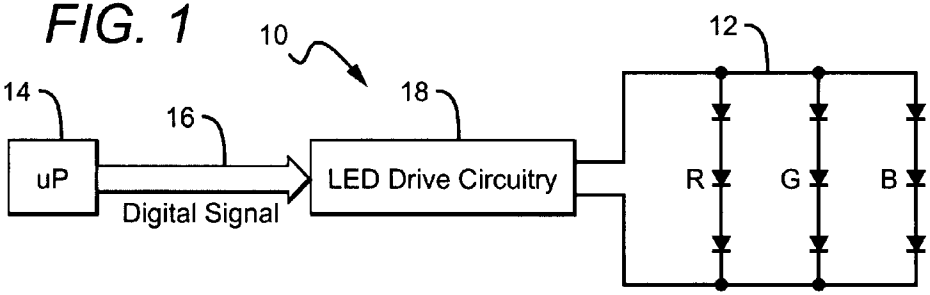
FIG. 1 is a block diagram of one embodiment of a system according to the present invention for controlling multiple LEDs.

The present invention provides an apparatus/system and method for controlling the brightness of multiple LEDs, wherein the LEDs can emit one color of light or the LEDs can emit different colors of light that combine to produce many different colors and intensities of light. Systems according to the present invention generally comprise a processor or microprocessor ("microprocessor") that provides a digital signal that is converted into a corresponding drive current. The drive current can vary depending on different digital signals from the microprocessor. It is understood, however, that systems according to the present invention can have a digital signal provided from other sources other than microprocessors.

In the preferred embodiment the digital signal is first converted to one or more analog voltages and the analog voltages are then converted to drive currents. Different embodiments of the present invention can convert the analog voltage to drive currents using different circuits including, but are not limited to; summing circuits, digital to analog converters, frequency to voltage converters, and counting circuits.

Although the embodiments below focus on LEDs as the emitters, it is understood that other conventional or solid state emitters can be used. In one embodiment according to the present invention, the apparatus and method are used to control the brightness of red, green and blue (RGB) LEDs to create these and other colors of light, including white.

In different embodiments of the present invention a system is provided that is flexible enough to be arranged between standard power supplies and many different lighting products containing LEDs, including but not limited to channel letter lighting, perimeter lighting, illuminated signs, spa lighting, and other commercial and residential lighting applications. The system can accept external controls, such as by a mechanical switch, or under software/hardware control, to generate any fixed color or color modes such as color flashing or color changing.

The present invention also provides many advantages over the prior art including the controlling of multiple LEDs using signals that are not pulse width modulated, and does not rely on pulsing to control the intensity of illumination. Instead, a direct current (DC) drive current is provided having a level that is set by the microprocessor provided digital signal. Because the drive current is DC, the illumination of the LEDs does not pulse such that emission "flicker" is reduced. The illumination of the LEDs is held at the desired level until the drive current is changed by a new binary signal. The resulting system has reduced EMI noise compared to systems using pulse width modulated signals, and the systems can be less complicated and easier to implement.

The present invention also provides for color and intensity control of the LEDs at high resolution determined by the digital resolution of the microprocessor provided digital signal. The system can also be easily scalable to control a greater number of LEDs in one or more LED groups.

The present invention is described herein with reference to certain embodiments but it is understood that the invention can be embodied in many different forms with many different components, and should not be construed as limited to the embodiments set forth herein. It is also understood that when an element or component is referred to as being "connected to", "coupled to", or "in electrical contact with" another element, it can be directly connected to or coupled to the element, or directly in electrical contact with the element. It is understood however that intervening elements may also be present. It is also understood that an element or component referred to arranged to "accept" are as "accepting" a electrical voltage, current or signal, it can directly accept the voltage, current or signal, or can accept them through intervening elements.

Although the terms first, second, etc. may be used herein to describe various elements, components, and/or sections, these elements, components, and/or sections should not be limited by these terms. These terms are only used to distinguish one element, component, or section from another element, component or section. Thus, a first element, component, or section discussed below could be termed a second element, component, or section without departing from the teachings of the present invention.

FIG. 1 shows one embodiment of a system 10 for controlling multiple LEDs 12, with the embodiment shown controlling groups of red, green and blue LEDs. It is understood, however, that the system 10 can control other numbers of LEDs in different groups that can emit many different colors of light. The system 10 comprises a microprocessor 14 that can be one of many different conventional and commercially available microprocessors, with a suitable microprocessor being the PIC16F87 microcontroller commercially available from Microchip Technology Inc. The microprocessor 14 can be programmed using known programming software and methods to create a digital signal 16. As further discussed below, the microprocessor can also be arranged to accept certain inputs, such as user inputs, that can be used to program the microprocessor to change the digital signal output. In these embodiments, the contents of the digital signal 16 can at least partially be determined by the inputs accepted by the microprocessor 14. Digital signal 16 comprises one or more "ones" (high voltage) or "zeros" (low voltage) that can be provided in either parallel through a number of conductors (pins) from the microprocessor 14, or can be provided as a serial data stream, typically on one conductor.

The system 10 further comprises LED drive circuitry 18 comprised of electrical and electronic elements/components that can accept the digital signal 16 from the microprocessor 14 and convert it to a drive current. The drive current can then be coupled to the LEDs 12 causing them to emit light. The LEDs 12 can be controlled as a group by one drive current, or multiple drive currents can be provided to control groups of the LEDs 12. In one embodiment, the drive circuitry 18 can generate three drive currents from the digital signal 16, with each of the drive currents coupled to a respective one of the red, green and blue groups of LEDs 12, shown as groups R, B and B in FIG. 1. This allows the intensity of each of the groups to be separately controlled by its drive current.

Figure 2:
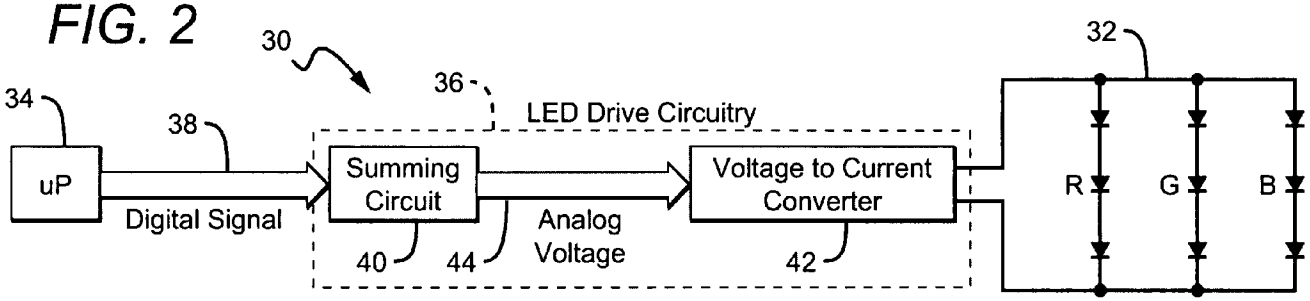
FIG. 2 is a block diagram of one embodiment of a summing circuit based system according to the present invention for controlling multiple LEDs.

As mentioned above, the systems according to the present invention can use many different components arranged in many different ways to convert one or more digital signals into one or more corresponding drive currents. FIG. 2 shows one embodiment of a system 30 according to the present invention comprising LEDs 32 and a microprocessor 34 arranged similar to the LEDs 12 and microprocessor 14 shown in FIG. 1 and described above. The system 30 further comprises LED drive circuitry 36 that accepts a digital signal 38 from the microprocessor 34 and converts it into drive current(s) for the LEDs 32.

In this embodiment, the drive circuitry 36 comprises a summing circuit 40 and a voltage to current converter 42. The summing circuit 40 comprises known elements/components coupled together to sum the ones (or highs) from the digital signal 38 to generate an analog voltage 44 that is coupled to the voltage to current converter 42. An analog voltage refers to a voltage having a substantially constant voltage (V) over time for its corresponding digital signal, with different digital signals resulting in different analog voltages. In a preferred embodiment, the more ones in the digital signal 38 the higher the resulting generated analog voltage 44.

The voltage to current converter 42 comprises known elements/components coupled together to accept the analog voltage 44 and generates the drive current(s) for the LEDs. In system 10 described above, the drive circuitry 36 in system 30 can be arranged to generate three drive currents from the digital signal 16, with each of the drive currents coupled to a respective one of the red, green and blue groups of LEDs 12. This allows the intensity of each of the groups to be separately controlled by its drive current.

Figure 3:
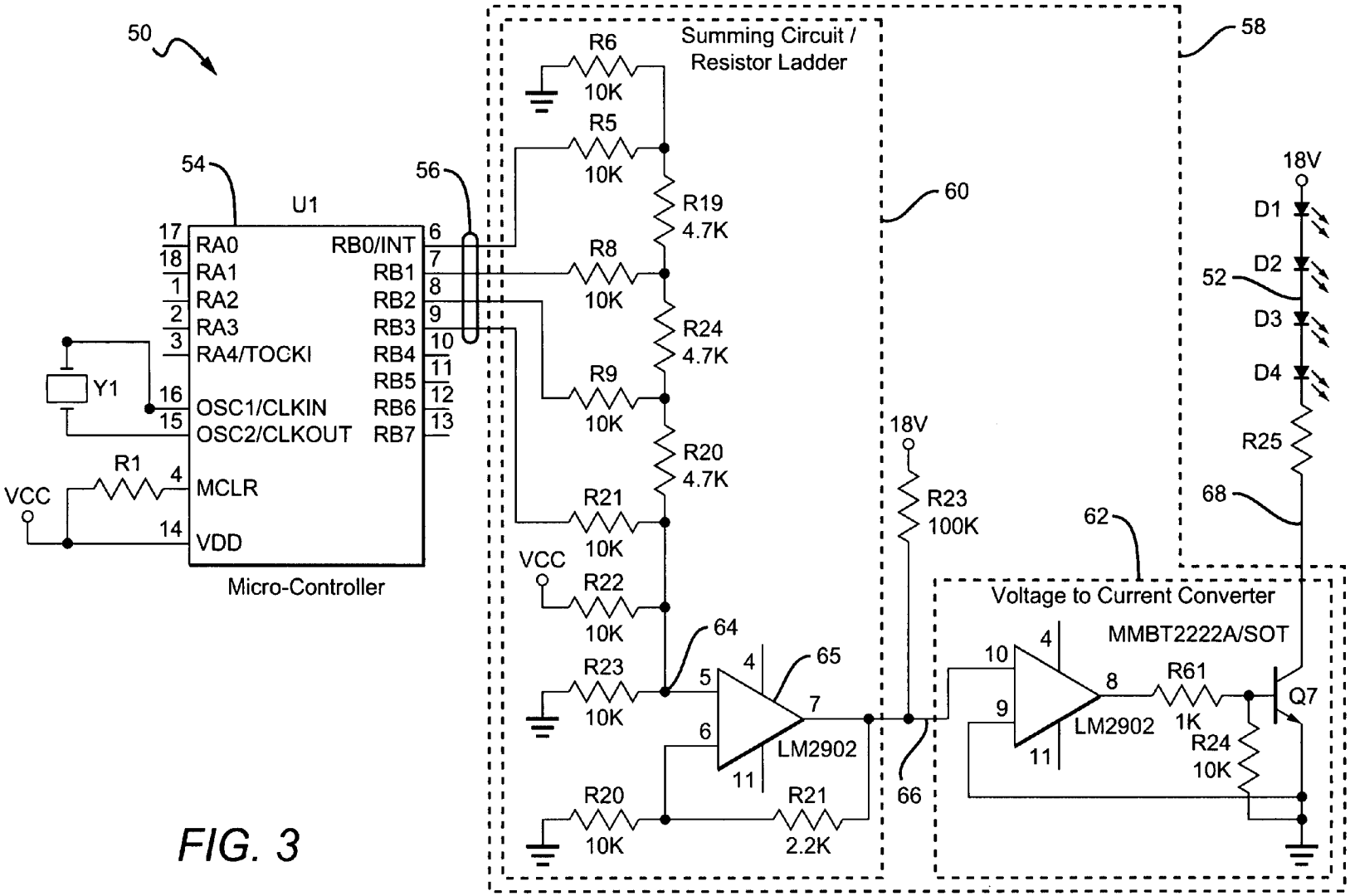
FIG. 3 is a schematic of one embodiment of a summing circuit based system according to the present invention for controlling multiple LEDs.

FIG. 3 shows in more detail one embodiment of a summing circuit based system 50 for controlling a single group of LEDs (D1-D4) 52. The system 50 comprises a microprocessor 54 that can be many different known microprocessors. Microprocessors are commercially available, generally known in the art and are only discussed briefly herein. The microprocessor 54 has an oscillator Y1 coupled to the OSC/CLK input and output to provide the microprocessor's internal clock timing. Vcc is coupled across the microprocessor's VDD and MCLR inputs to provide power to the microprocessor 54. The microprocessor further comprises output conductors (pins RB0-RB3 that carry the microprocessor's digital signal 56. Additional pins RA0-RA4 and RB4-RB7 are available in systems having more than one set of LEDs to control.

In some embodiments of the system 50 the microprocessor 54 is programmed by algorithms that change the digital signal 56 without outside intervention. Alternatively, input signals (not shown) can be provided to the microprocessor that could work with the program algorithms to change the digital signal 56. In some embodiments this input signal could be in the form of a user interface, such as a wheel, dial, toggle, button or switch. Alternatively, an external device could provide an input to the microprocessor without user intervention. Many other inputs can also be provided including, but not limited to, keypads, computer interfaces such USB, wireless, Ethernet, etc.

The system 50 further comprises an LED drive circuit 58 that comprises a summing circuit 60 and voltage to current converter 62 as described above in FIG. 2. Different summing circuits can be used in systems according to the present invention, with the summing circuit 60 comprising a resistor ladder network that is generally known in the art and only briefly discussed herein. The resistor ladder network accepts the digital signal 56 and sums the voltages from the digital signal ones (or highs) at summing node 64. The total voltage at node 64 is higher depending on the number of ones (or highs) in the digital signal 56. The voltage at the node 64 comprises the analog voltage that is transmitted from the summing circuit 60 to the voltage to current converter 62. The summing circuit further comprises an operational amplifier 65 coupled to the ladder network and surrounding elements using known techniques to change the voltage level from the node 64. The analog voltage from the summing circuit 60 is provided at the output of the operational amplifier 65.

The voltage to current converter 62 accepts the analog signal and generates an LED drive current based on the level of the analog voltage on first conductor 66. The voltage to current converter 62 can have many different components arranged in many different ways with the embodiment shown having an operational amplifier 67 coupled to the summing circuit and surrounding elements using known techniques. Many different operational amplifiers can be used for amplifier 67 (and operation amplifier 65) with a suitable operational amplifier being a LM2902 Low Power Quad Operational Amplifiers commercially available from National Semiconductor Corporation. The voltage to current converter provides a drive current on second conductor 68 that causes the LEDs 52 to emit light. The higher the level of the analog voltage the higher the drive current and the brighter the LEDs 52 illuminate.

The system 50 is easily scalable to control multiple groups of LEDs similar to the system, such as a system with red, green and blue groups, each of which can be independently controlled. Two additional LED drive circuits can be included to provide a total of three LED drive circuits each of which is coupled to a respective one of the red, green and blue groups of LEDs. The additional LED drive circuits each comprise a summing circuit and voltage to current converter. The microprocessor 54 provides two additional digital signals on its output pins RA0-RA4 and RB4-RB7. The two additional digital signals can be coupled to a respective one of the additional LED drive circuits, and in particular to one of the two additional summing circuits. Each of the summing circuits generates an analog voltage that is then converted to a drive current by its voltage to current converter.

It is understood that the systems according to the present invention can be arranged to generate many different numbers of drive currents to independently control illumination of different numbers of single LEDs or different numbers of LED groups. In some embodiments, additional microprocessors can be included having corresponding LED drive circuits producing additional drive currents.

Figure 4:
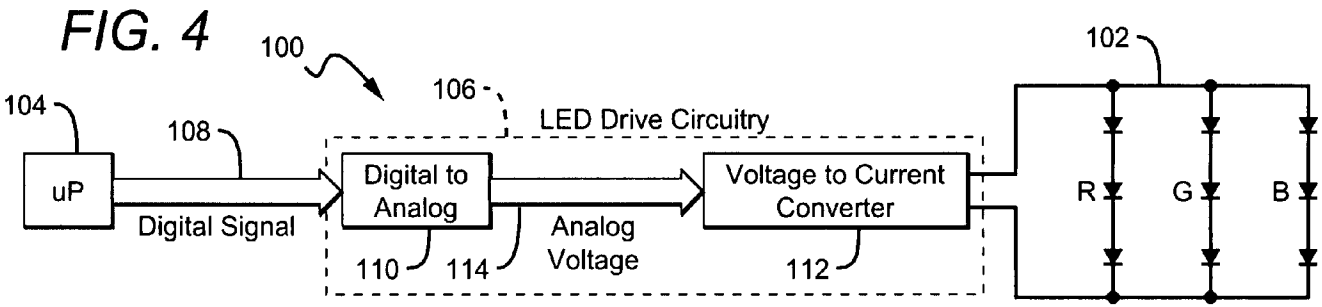
FIG. 4 is a block diagram of one embodiment of a digital to analog converter based system according to the present invention for controlling multiple LEDs.

FIG. 4 shows another embodiment of system 100 for controlling multiple LEDs with the system 100 comprising LEDs 102 and a microprocessor 104 similar to LEDs 32 and a microprocessor 34 described above and shown in FIGS. 2 and 3. The system 100 further comprises LED drive circuitry 106 that accepts the digital signal 108 from the microprocessor 104 and converts it to drive current(s) for the LEDs 102. The drive circuitry 106 comprises a digital to analog (D/A) converter 110 and a voltage to current converter 112. The D/A converter can comprise known elements/components coupled together to accept the digital signal 108 and convert it to an analog voltage having a level based on the digital signal. Different combinations of ones (highs) and zeros (lows) from the digital signal 108 can result in different voltage levels for the analog voltage 114. The analog voltage 114 is coupled to the voltage to current converter 112 comprising known elements/components coupled together to accept the analog voltage 114 and generate the drive current(s) for the LEDs 102.

Similar to system 30 described above, the drive circuitry 106 in system 100 can be arranged to generate different numbers of drive currents from the digital signal 108. In some embodiments one drive current can be generated, while in other embodiments two or more drive currents can be generated. In one embodiment, three drive currents are generated, with each of the drive currents coupled to a respective one of the red, green and blue groups of LEDs 102. This allows the intensity of each of the groups to be separately controlled by its drive current to generate different colors of light of different intensities.

Figure 5:
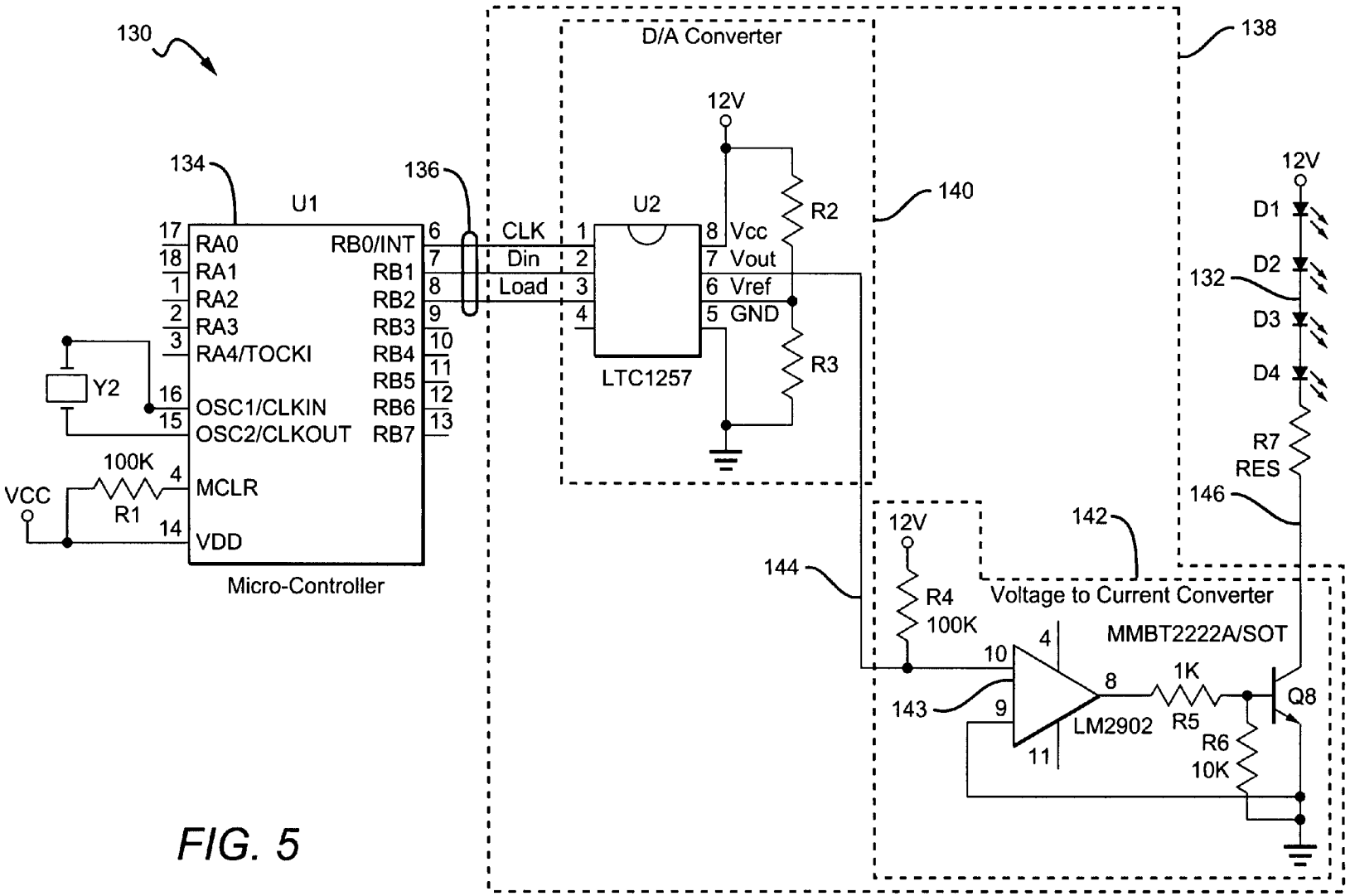
FIG. 5 is a schematic of a digital to analog converter based system according to the present invention for controlling multiple LEDs.

FIG. 5 shows in more detail one D/A converter based embodiment of system 130 for controlling multiple LEDs. The system 130 comprises a group of LEDs 132 and a microprocessor 134 similar to the LEDs 52 and microprocessor 54 described above and shown in FIG. 3. The microprocessor 134 is similarly programmed and in different embodiments can work with or without external generating digital signals. The microprocessor 134 is coupled to oscillator Y1 and VCC is programmed using known methods. The microprocessor 134 provides a digital signal 136 on RB0-RB2 that is coupled to LED drive circuitry 138 that comprises a D/A converter 140 and a voltage to current converter 142. The D/A converter 140 can comprise many different elements and components with a suitable D/A converter comprising an LTC1257 12-bit Voltage Output D/A converter commercially available from Linear Technology Corporation. These types of D/A converters are generally known in the art and are only briefly discussed herein. The microprocessor 134 provides a digital signal 136 to the D/A converter 140 that comprises CLK, Din and Load signals. The Din comprises a serial digital pulse train that is latched into a shift register in the D/A converter on the rising edge of the CLK signal. The data from the shift register is loaded into the D/A register in the D/A converter when the Load signal is low, thereby updating the output voltage Vout.

Vout comprises the analog voltage on first conductor 144 that is coupled to the voltage to current converter 142. The voltage to current converter 142 can comprise many different elements/components arranged in many different ways. In the embodiment shown it comprises an operational amplifier 143 similar to the one shown in FIG. 2 that is preferably an LM2902 Low Power Quad Operational Amplifiers commercially available from National Semiconductor Corporation. The voltage to current converter 142 accepts the analog voltage 144 and provides a drive current on second conductor 146, with the drive current causing the LEDs 132 to emit light. The higher the level of the analog voltage the higher the drive current and the brighter the LEDs 132 illuminate.

The system 130 is scalable to control multiple groups of LEDs such as groups of red, green and blue LEDs each of which can be independently controlled. Two additional LED drive circuits can be provided and the microprocessor can provide two additional serial digital signals, each of which is coupled to its own D/A converter. Each D/A converter provides an analog voltage that is coupled to its own voltage to current converter. The voltage to current converter generates a drive current that is couple to one of the red, green or blue groups of LEDs. It is understood that the systems can be further scaled to produce additional current drives by the microprocessor providing additional serial digital signals or by providing additional microprocessors providing additional digital signals that can then be converted to drive currents.

Figure 6:
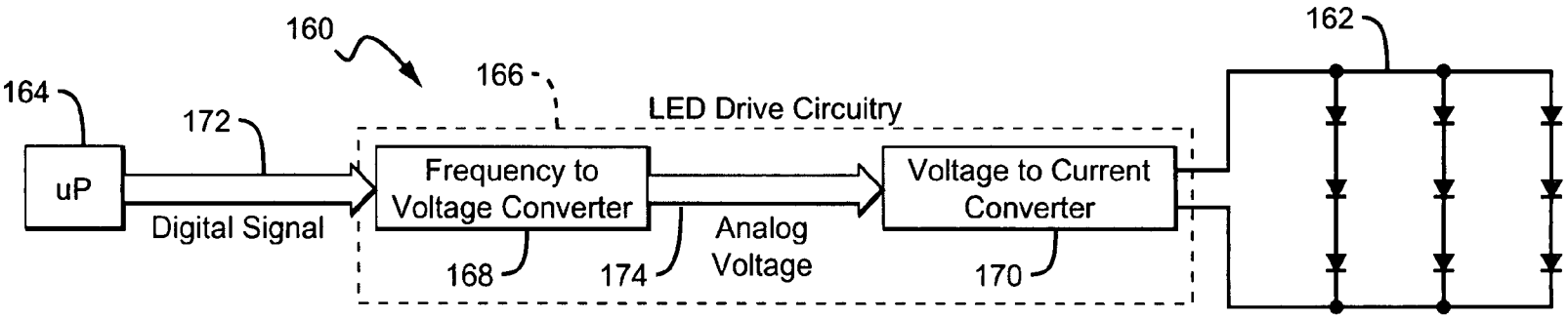
FIG. 6 is a block diagram of one embodiment of a frequency to voltage converter based system according to the present invention for controlling multiple LEDs.

FIG. 6 shows another embodiment of system 160 for controlling illumination of multiple LEDs 162 that can comprise groups of red, green and blue LEDs. The system comprises a microprocessor 164 similar to those described above, and an LED drive circuit 166 comprising a frequency to voltage converter 168 and a voltage to current converter 170. The frequency to voltage converter 168 accepts a digital signal 172 from the microprocessor and generates an analog voltage 174. The level of the analog voltage 174 is generally dependent upon the frequency of ones (highs) in the digital signal 172; the higher the frequency the higher the analog voltage 174. The analog voltage 174 is then coupled to the voltage to current converter 170 that in turn generates drive current(s) for the LEDs 162.

Figure 7:
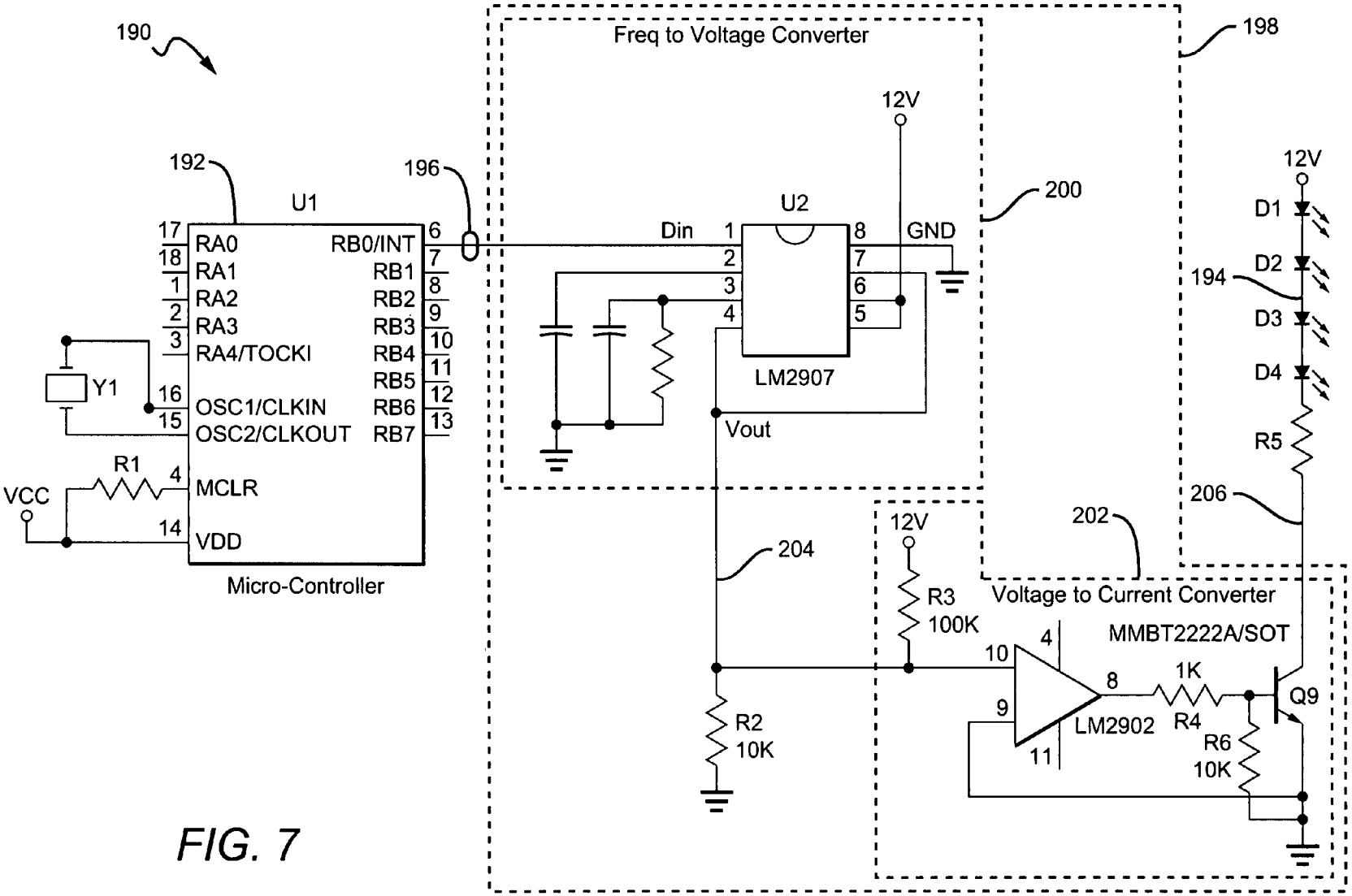
FIG. 7 is a schematic of a frequency to voltage converter based system according to the present invention for controlling multiple LEDs.

FIG. 7 shows one embodiment of a frequency to voltage converter based system 190 in more detail. The system comprises a microprocessor 192 and LEDs 194 with the microprocessor being similar to those described above. In this embodiment, the microprocessor generates a digital signal 196 at RB0 that comprises a serial digital stream. The system 190 further comprises an LED drive circuit 198 comprising a frequency to voltage converter 200 and a voltage to current converter 202.

Many different elements/components can be used for the frequency to voltage converter 200, with a suitable component being a LM2907 Frequency to Voltage Converter commercially available from National Semiconductor Corporation. This converter accepts the serial data stream digital signal 196 from the microprocessor 192 and generates an analog voltage on first conductor 204 having a level depending on the frequency of ones (highs) in the digital signal. The converter 200 is arranged as shown with the suitable timing capacitor, output resistor, and integrating or filter capacitor that are chosen using known methods to allow the conversion of input frequency into an analog voltage.

The analog voltage on first conductor 204 is coupled to the voltage to current converter 202 that is similar to those described above and preferably comprises the same LM2902 Low Power Quad Operational Amplifiers commercially available from National Semiconductor Corporation. Like the embodiments above, the converter accepts the analog voltage from first conductor 204 and generates a drive current on second conductor 206 to illuminate LEDs 194.

The system 190 is also scalable to control multiple groups of LEDs. In such a system red, green and blue groups of LEDs can be provided each of which can be independently controlled. The microprocessor can provide three digital signals each of which is coupled to its own frequency to voltage converter, which in turn provides an analog voltage to its own voltage to current converter. The voltage to current converter generates a drive current that is coupled to one of the red, green or blue groups of LEDs. This system can also be arranged to generate many different numbers of drive currents to independently control illumination of different numbers of single LEDs or different numbers of LED groups.

Figure 8:
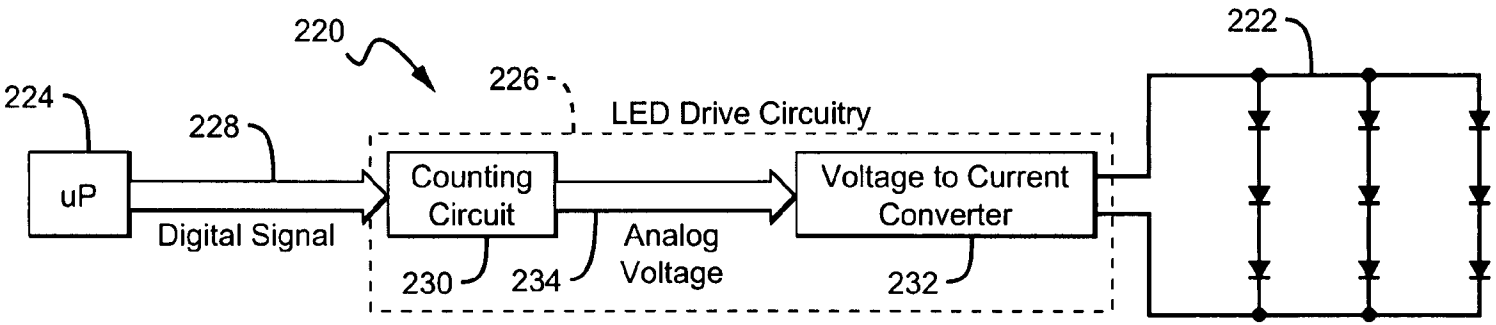
FIG. 8 is a block diagram of one embodiment of a counting circuit based system according to the present invention for controlling multiple LEDs.

FIG. 8 shows still another embodiment of a system 220 for controlling multiple LEDs 222. The system comprises a microprocessor 224 similar to those described above, and an LED drive circuit 226 that accepts a digital signal 228 from the microprocessor 224 and generates drive current(s) for the LEDs 222. The drive circuit comprises a counting circuit 230 and a voltage to current converter 232. The counting circuit 230 accepts the digital signal 228 from the microprocessor 224 and depending on the number of ones (highs) in the digital signal the counting circuit generates an analog voltage 234. In one embodiment, the analog voltage 234 increases when the number of ones in the digital signal 228 increases, although it is understood that in other embodiments the analog voltage can go down as the number of ones in the digital signal goes up. Still in other embodiments, the voltage level can depend in different ways on the combinations in the digital signal. Many different counting circuits can be used including with one suitable circuit comprising a counter used with a operational amplifier based integrator to create a stair step waveform by adding the pulses as they are transmitted from the microprocessor. The counter can be used to restart the formation of the stair step waveform.

The voltage to current converter 232 can be arranged with the components described above, but it is understood that other components can also be used. The converter 232 accepts the analog voltage 234 and generates drive current(s) to illuminate the LEDs 222. The converter can be arranged to generate a single drive current that can be applied to one or all of the red, green and blue groups of LEDs 222. In other embodiments, three drive currents can be generated, each of which illuminates a respective one of the red, green or blue groups of LEDs. As with the systems described above, the system 220 can also be scaled to illuminate more than three individual or groups of LEDs.

Figure 9:
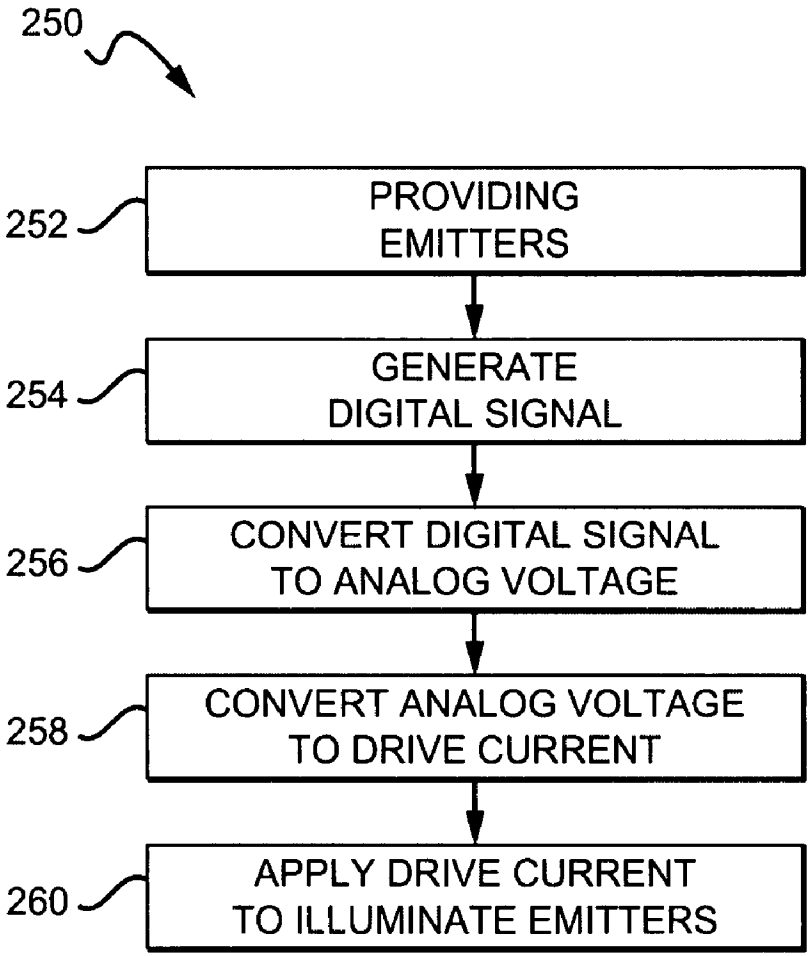
FIG. 9 is flow diagram for one embodiment of a method for illuminating LEDs according to the present invention.

The present invention also comprises methods for illuminating LEDs and FIG. 9 shows one embodiment of an illumination method 250 according to the present invention. Although the method 250 is described with reference to a method for illuminating emitters, it is understood that the method can be used to illuminate many different types of emitters with the preferred emitter being LEDs. It is further understood that although the method 250 is shown as a series of steps, the steps can occur in different order and different steps can be employed.

In 252 emitters are provided and in step 254 a digital signal is generated. One embodiment is generated by a microprocessor as described above, although it is understood that the digital signal can be generated in other ways. The digital signal can be generated in either serial or parallel form, and in either case comprises a plurality of ones (high) and/or zeroes (low).

In 256 the digital signal is converted to one or more analog voltages using any one of the arrangements with the components as described above. It is understood, that a different number of analog voltages can be products and that other circuits and components can also be used. In 258 each analog voltage is converted to a drive current, preferably by a voltage to current converter as described above, although other circuits and components can be used.

In 260 each of the drive currents is applied to illuminate one or more LEDs. In one embodiment a single drive current is produced that is applied to a single LED or group of LEDs. In other embodiments multiple drive currents are produced, each of which is applied to a respective group of LEDs. This is particularly applicable to applying respective drive currents to groups of red, green and blue LEDs.

Although the present invention has been described in considerable detail with reference to certain preferred configurations and methods, other versions are possible. Therefore, the spirit and scope of the appended claims should not be limited to the preferred versions described above.

I claim:

1. A system for illuminating an emitter, comprising:

an emitter;

a first circuit programmed to provide a digital signal comprising a binary signal provided in either parallel through a number of conductors or as a serial data stream; and a second circuit arranged to accept said digital signal and generate a direct current drive current signal having a level based at least partially on said digital signal, said direct current drive current signal being unmodulated and directly applied to said emitter to cause it to emit light, the intensity of emission from said emitter dependent at least partially upon the level of said direct current drive current signal;

said second circuit comprising a first converter to convert said digital signal to an analog voltage and a second converter to convert said analog voltage to a drive current; said second converter comprising an operational amplifier coupled to a transistor.

2. The system of claim 1, wherein said emitter comprises a light emitting diode (LED).

3. The system of claim 1, wherein said first circuit comprises a microprocessor.

4. The system of claim 1, wherein said first converter comprises a summing circuit.

5. The system of claim 1, wherein said first converter comprises a resistor ladder.

6. The system of claim 1, wherein said first converter comprises a digital to analog converter.

7. The system of claim 1, wherein said first converter comprises a frequency to voltage converter.

8. The system of claim 1, wherein said first converter comprises a counting circuit.

9. A system for illuminating a plurality of light emitting diodes (LEDs), comprising:

a plurality of LEDs;

a circuit to provide a digital signal comprising a binary signal provided in either parallel through a number of conductors or as a serial data stream;

a first converter for converting said digital signal to one or more analog voltages;

a second converter comprising an operational amplifier coupled to a transistor for converting said one or more analog voltages into corresponding one or more direct current drive currents, each of said direct current drive currents being unmodulated and directly applied to at least one of said plurality of LEDs to cause said at least one of said plurality of LEDs to emit light, the intensity of emission related to the level of said applied direct current drive current.

10. The system of claim 9, wherein said plurality of LEDs comprises groups of red, green and blue LEDs.

11. The system of claim 10, wherein each said one or more drive currents is applied to a respective one of said groups of red, green and blue LEDs.

12. The system of claim 9, wherein said circuit comprises a microprocessor.

13. The system of claim 9, wherein said first converter comprises a summing circuit.

14. The system of claim 9, wherein said first converter comprises a resistor ladder.

15. The system of claim 9, wherein said first converter comprises a digital to analog converter.

16. The system of claim 9, wherein said first converter comprises a frequency to voltage converter.

17. The system of claim 9, wherein said first converter comprises a counting circuit.

18. A method for illuminating emitters, comprising:

providing one or more emitters;

generating a digital signal comprising a binary signal provided in either parallel through a number of conductors or as a serial data stream;

converting the digital signal to one or more analog voltages;

converting each of said one or more analog voltages to corresponding one or more direct current drive currents by a voltage to current converter comprising an operational amplifier coupled to a transistor; and applying each of said one or more direct current drive currents directly to at least one of said one or more emitters, wherein said direct current drive currents are unmodulated prior to being applied to said emitters.

19. The method of claim 18, wherein said one or more emitters comprise one or more light emitting diodes (LEDs).

20. The method of claim 18, wherein said LEDs comprise groups of red, green and blue LEDs and each of said one or more direct current drive currents is applied to a respective one of said groups.

21. The method of claim 18, wherein one of said one or more direct current drive currents having a level different from one or more of said remaining direct current drive currents.

22. The method of claim 18, wherein said digital signal is generated by a microprocessor.

23. The method of claim 18, wherein said digital signal is converted to said one or more analog voltages by a summing circuit.

24. The method of claim 18, wherein said digital signal is converted to said one or more analog voltages by a digital to analog conversion circuit.

25. The method of claim 18, wherein said digital signal is converted to said one or more analog voltages by a frequency to voltage conversion circuit.

26. The method of claim 18, wherein said digital signal is converted to said one or more analog voltages by a counting circuit.

27. The method of claim 18, wherein said one or more emitters comprise one or more light emitting diodes (LEDs).

* * * * *